US010966459B2

(12) United States Patent
Fernando et al.

(10) Patent No.: US 10,966,459 B2
(45) Date of Patent: Apr. 6, 2021

(54) ELECTRICALLY HEATED SMOKING SYSTEM

(71) Applicant: PHILIP MORRIS USA INC., Richmond, VA (US)

(72) Inventors: Felix Fernando, Wokingham (GB); Fredrik Stahle, Vevey (CH); Jean-Pierre Cordey, Cheseaux (CH); Laurent Manca, Belmont-sur-Lausanne (CH)

(73) Assignee: Altria Client Services LLC, Richmond, VA (US)

( * ) Notice: Subject to any disclaimer, the term of this patent is extended or adjusted under 35 U.S.C. 154(b) by 762 days.

(21) Appl. No.: 14/492,500

(22) Filed: Sep. 22, 2014

(65) Prior Publication Data

US 2015/0007838 A1 Jan. 8, 2015

Related U.S. Application Data

(63) Continuation of application No. 13/841,197, filed on Mar. 15, 2013, now Pat. No. 8,851,081, which is a continuation of application No. 12/425,622, filed on Apr. 17, 2009, now Pat. No. 8,402,976.

(30) Foreign Application Priority Data

Apr. 17, 2008 (EP) ..... 08251450

(51) Int. Cl.
*A24F 47/00* (2006.01)

(52) U.S. Cl.
CPC ..... *A24F 47/008* (2013.01); *A24F 47/00* (2013.01)

(58) Field of Classification Search
CPC .. A61M 11/041; A61M 15/00; A61M 11/065; A61M 11/042; A61M 2205/3368; A61M 16/16; A61M 16/161; Y10S 261/65; A62B 9/003; A24F 47/008; A24F 40/00; A24F 40/40; A24F 40/46
See application file for complete search history.

(56) References Cited

U.S. PATENT DOCUMENTS

| | | | |
|---|---|---|---|
| 1,771,366 | A | 7/1930 | Wyss et al. |
| 1,968,509 | A | 7/1934 | Tiffany |
| 2,057,353 | A | 10/1936 | Whittemore, Jr. |
| 2,104,266 | A | 1/1938 | McCormick |
| 2,406,275 | A | 8/1946 | Wejnarth |
| 2,442,004 | A | 5/1948 | Hayward-Butt |
| 2,971,039 | A | 2/1961 | Western |
| 2,974,669 | A | 3/1961 | Ellis |
| 3,200,819 | A | 8/1965 | Gilbert |
| 3,280,819 | A | 8/1965 | Gilbert |
| 3,255,760 | A | 6/1966 | Selker |
| 3,258,015 | A | 6/1966 | Ellis et al. |
| 3,363,633 | A | 1/1968 | Weber |
| 3,402,723 | A | 9/1968 | Hu |
| 3,443,049 | A | 5/1969 | Hoagland |
| 3,482,580 | A | 12/1969 | Hollabaugh |
| 3,608,560 | A | 9/1971 | Briskin et al. |
| 3,738,374 | A | 6/1973 | Bennett |
| 3,744,496 | A | 7/1973 | McCarty et al. |
| 3,804,100 | A | 4/1974 | Fariello |
| 3,875,476 | A | 4/1975 | Crandall et al. |
| 3,889,690 | A | 6/1975 | Guarnieri |
| 3,895,219 | A | 7/1975 | Richerson et al. |
| 3,976,529 | A | 8/1976 | Weicjselbaum |
| 4,016,061 | A | 4/1977 | Wasa et al. |
| 4,068,672 | A | 1/1978 | Guerra |
| 4,077,784 | A | 3/1978 | Vayrynen |
| 4,098,725 | A | 7/1978 | Yamamoto et al. |
| 4,103,144 | A | 7/1978 | Pizzarello |
| 4,110,260 | A | 8/1978 | Yamamoto et al. |
| 4,131,119 | A | 12/1978 | Blasutti |
| 4,141,369 | A | 2/1979 | Burruss |
| 4,164,230 | A | 8/1979 | Pearlman |
| 4,193,411 | A | 3/1980 | Faris et al. |
| 4,215,708 | A | 8/1980 | Bron |
| 4,219,032 | A | 8/1980 | Tabatznik et al. |
| 4,246,913 | A | 1/1981 | Ogden et al. |
| 4,256,945 | A | 3/1981 | Carter et al. |
| 4,259,970 | A | 4/1981 | Green, Jr. |
| 4,303,083 | A | 12/1981 | Burruss, Jr. |

(Continued)

FOREIGN PATENT DOCUMENTS

| | | |
|---|---|---|
| CA | 1 202 378 | 3/1986 |
| CA | 2768122 A1 | 11/2007 |

(Continued)

OTHER PUBLICATIONS

KR 10-0636287—English Mechanical Translation printed from EPO.org (Year: 2019).*
Dictionary.com entry for the word "blade", printed from the internet on Aug. 14, 2019.*
"Joining of Ceramics" by R.E. Loehman et al., published in Ceramic Bulletin, 67(d); 375-380 (1988).
Oxidation Behavior of Silver—and Copper-Based Brazing Filler Metals for Silicon Nitride/Metal Joints by R.R. Kapoor et al., published in J. Am. Ceram. Soc., 72(3):448-454 (1989).

(Continued)

*Primary Examiner* — Michael H. Wilson
*Assistant Examiner* — Dionne W. Mayes
(74) *Attorney, Agent, or Firm* — Harness, Dickey & Pierce, P.L.C.

(57) ABSTRACT

An electrically heated smoking system for receiving an aerosol-forming substrate. includes at least one heating element for heating the substrate to form an aerosol, a power supply for supplying power to the heating element, electrical hardware connected to the power supply and the heating element, and an interface for establishing a communications link with a host. The communications link can be a USB link and the host can be a personal computer.

8 Claims, 2 Drawing Sheets

(56) References Cited

U.S. PATENT DOCUMENTS 4,311,448 A 1/1982 Strauss
4,319,591 A 3/1982 Keith et al.
4,327,186 A 4/1982 Murata et al.
4,355,222 A 10/1982 Geithman et al.
4,393,884 A 7/1983 Jacobs
4,407,971 A 10/1983 Komatsu et al.
4,416,840 A 11/1983 Lee et al.
4,431,903 A 2/1984 Riccio
4,449,039 A 3/1984 Fukazawa et al.
4,436,100 A 4/1984 Green, Jr.
4,463,247 A 7/1984 Lawrence et al.
4,467,165 A 8/1984 Kiuchi
4,475,029 A 10/1984 Yoshida et al.
4,488,335 A 12/1984 Fox
4,503,319 A 3/1985 Moritoki et al.
4,505,282 A 3/1985 Cogbill et al.
4,521,659 A 6/1985 Buckley
4,528,121 A 7/1985 Matsushita et al.
4,549,905 A 10/1985 Yamaguchi et al.
4,555,358 A 11/1985 Matsushita et al.
4,562,337 A 12/1985 Lawrence
4,570,646 A 2/1986 Herron
4,572,216 A 2/1986 Josuttis et al.
4,580,583 A 4/1986 Greent, Jr.
4,615,681 A 10/1986 Schwarz
4,621,649 A 11/1986 Osterrath
4,623,401 A 11/1986 Derbyshire et al.
4,634,837 A 1/1987 Ito et al.
4,637,407 A 1/1987 Bonanno et al.
4,659,912 A 4/1987 Derbyshire
4,714,082 A 12/1987 Banerjee et al.
4,735,217 A 4/1988 Gerth et al.
4,765,859 A 9/1988 Health et al.
4,771,796 A 9/1988 Myer
4,776,353 A 10/1988 Lilja et al.
4,789,767 A 12/1988 Doljack
4,837,421 A 6/1989 Luthy
4,846,199 A 7/1989 Rose
4,848,376 A 7/1989 Lilja et al.
4,874,924 A 10/1989 Yamamoto et al.
4,877,989 A 10/1989 Drews et al.
4,922,901 A 5/1990 Brooks et al.
4,945,931 A 8/1990 Gori
4,947,874 A 8/1990 Brooks et al.
4,947,875 A 8/1990 Brooks et al.
4,966,171 A 12/1990 Serrano et al.
4,981,522 A 1/1991 Nichols et al.
4,991,606 A 2/1991 Serrano et al.
5,016,656 A 5/1991 McMurtrie
5,040,551 A 8/1991 Schlatter et al.
5,040,552 A 8/1991 Nystrom et al.
5,042,510 A 8/1991 Curtiss et al.
5,045,237 A 9/1991 Washburn
5,060,671 A 10/1991 Counts et al.
5,075,529 A 12/1991 Kudo
5,076,296 A 12/1991 Schleich et al.
5,080,115 A 1/1992 Templeton
5,085,804 A 2/1992 Counts et al.
5,093,894 A 3/1992 Deevi et al.
5,095,921 A 3/1992 Losee et al.
5,101,086 A 3/1992 Dion et al.
5,159,940 A 3/1992 Hayward et al.
5,139,594 A 8/1992 Rabin
5,144,962 A 9/1992 Counts et al.
5,157,242 A 10/1992 Hetherington et al.
5,179,966 A 1/1993 Losee et al.
5,188,130 A 2/1993 Hajaligol
5,224,498 A 7/1993 Deevi et al.
5,228,460 A 7/1993 Sprinkel et al.
5,235,157 A 8/1993 Blackburn
5,236,108 A 8/1993 House
5,249,586 A 10/1993 Morgan et al.
5,261,424 A 11/1993 Sprinkel, Jr.
5,268,553 A 12/1993 Shimoji
5,269,327 A 12/1993 Counts et al.
5,274,214 A 12/1993 Blackburn
5,285,050 A 2/1994 Blackburn
5,322,075 A 6/1994 Deevi et al.
5,353,813 A 10/1994 Deevi et al.
5,369,723 A 11/1994 Counts et al.
5,372,148 A 12/1994 McCafferty et al.
5,388,574 A 2/1995 Ingebrethsen
5,388,594 A 2/1995 Counts et al.
5,396,911 A 3/1995 Casey, III et al.
5,408,574 A 4/1995 Deevi et al.
5,469,871 A 11/1995 Barnes et al.
5,479,948 A 1/1996 Counts et al.
5,498,855 A 3/1996 Deevi et al.
5,499,636 A 3/1996 Baggett et al.
5,505,214 A 4/1996 Collins et al.
5,514,630 A 5/1996 Willkens et al.
5,530,225 A 6/1996 Hajaligol
5,591,368 A 1/1997 Fleischhauer et al.
5,613,504 A 3/1997 Collins et al.
5,613,505 A 3/1997 Campbell et al.
5,665,262 A 9/1997 Hajaligol
5,666,977 A 9/1997 Higgins et al.
5,666,978 A 9/1997 Counts et al.
5,708,258 A 1/1998 Counts et al.
5,750,964 A 5/1998 Counts et al.
5,819,751 A 10/1998 Barnes et al.
5,819,756 A 10/1998 Mielordt
5,865,185 A 2/1999 Collins et al.
5,894,841 A 4/1999 Voges
5,934,289 A 8/1999 Watkins et al.
6,026,820 A 2/2000 Baggett, Jr. et al.
6,040,560 A 3/2000 Fleischhauer et al.
6,155,268 A 12/2000 Takeuchi
6,196,218 B1 3/2001 Voges
6,443,146 B1 9/2002 Voges
6,446,426 B1 9/2002 Sweeney et al.
6,598,607 B2 7/2003 Adiga et al.
6,615,840 B1 9/2003 Fournier et al.
6,688,313 B2 2/2004 Wrenn et al.
6,701,921 B2 * 3/2004 Sprinkel, Jr. et al. ..... A61M 11/041 128/203.26
6,772,756 B2 8/2004 Shayan
6,803,545 B2 10/2004 Blake et al.
6,810,883 B2 11/2004 Felter et al.
6,854,470 B1 2/2005 Pu
6,990,978 B2 1/2006 Shayan
7,028,693 B2 4/2006 Brue
7,131,599 B2 11/2006 Katase
7,173,222 B2 2/2007 Cox et al.
7,211,986 B1 5/2007 Flowerdew et al.
7,293,565 B2 11/2007 Griffin et al.
7,458,374 B2 12/2008 Hale et al.
7,690,385 B2 4/2010 Moffitt
7,726,320 B2 6/2010 Robinson et al.
7,832,410 B2 11/2010 Hon
7,845,359 B2 12/2010 Montaser
7,997,280 B2 8/2011 Rosenthal
8,079,371 B2 12/2011 Robinson et al.
8,127,772 B2 3/2012 Montaser
8,156,944 B2 4/2012 Han
8,402,976 B2 3/2013 Fernando et al.
8,851,081 B2 10/2014 Fernando et al.
2002/0119873 A1 8/2002 Heitmann
2003/0070555 A1 4/2003 Reyhanloo
2003/0150451 A1 * 8/2003 Shayan ..... A61M 11/041 128/203.12
2003/0191973 A1 10/2003 Johnson
2004/0030508 A1 2/2004 Likness et al.
2004/0200488 A1 10/2004 Felter et al.
2005/0016550 A1 1/2005 Katase
2006/0112963 A1 6/2006 Scott et al.
2006/0118128 A1 6/2006 Hoffmann et al.
2006/0130860 A1 6/2006 Cholet
2006/0196518 A1 9/2006 Hon
2007/0006889 A1 1/2007 Kobal et al.
2007/0045288 A1 3/2007 Nelson
2007/0074734 A1 4/2007 Braunshteyn et al.
2007/0102013 A1 5/2007 Adams et al.

(56) References Cited

U.S. PATENT DOCUMENTS

| | | | | |
|---|---|---|---|---|
| 2007/0137646 | A1* | 6/2007 | Weinstein et al. .... | A61M 16/16 128/204.17 |
| 2008/0029109 | A1 | 2/2008 | Hercules | |
| 2008/0230052 | A1 | 9/2008 | Montaser | |
| 2008/0276947 | A1 | 11/2008 | Martzel | |
| 2009/0126745 | A1 | 5/2009 | Hon | |
| 2009/0151717 | A1 | 6/2009 | Bowen et al. | |
| 2009/0188490 | A1 | 7/2009 | Han | |
| 2009/0230117 | A1 | 9/2009 | Fernando et al. | |
| 2009/0272379 | A1 | 11/2009 | Thorens et al. | |
| 2010/0090644 | A1* | 4/2010 | Nokkonen et al. ..... | G06F 1/26 320/107 |
| 2010/0163063 | A1 | 7/2010 | Fernando et al. | |
| 2010/0307518 | A1 | 12/2010 | Wang | |
| 2010/0313901 | A1 | 12/2010 | Fernando et al. | |
| 2011/0094523 | A1 | 4/2011 | Thorens et al. | |
| 2011/0120482 | A1 | 5/2011 | Brenneise | |
| 2011/0126848 | A1 | 6/2011 | Zuber et al. | |
| 2011/0147486 | A1 | 6/2011 | Greim et al. | |
| 2011/0155151 | A1 | 6/2011 | Newman et al. | |
| 2011/0155153 | A1 | 6/2011 | Thorens et al. | |
| 2011/0155718 | A1 | 6/2011 | Greim et al. | |
| 2011/0168194 | A1 | 7/2011 | Hon | |
| 2011/0209717 | A1 | 9/2011 | Han | |
| 2011/0309157 | A1 | 12/2011 | Yang et al. | |
| 2012/0090630 | A1 | 4/2012 | Hon | |

FOREIGN PATENT DOCUMENTS

| | | | |
|---|---|---|---|
| CN | 87/104459 | A | 2/1988 |
| CN | 1040914 | | 4/1990 |
| CN | 1 060 598 | A | 4/1992 |
| CN | 1122213 | | 5/1996 |
| CN | 1491598 | A | 4/2004 |
| CN | 1530041 | A | 9/2004 |
| CN | 1541577 | A | 11/2004 |
| CN | 2719043 | Y | 8/2005 |
| CN | 201067079 | | 6/2006 |
| CN | 1284493 | | 11/2006 |
| CN | 101019694 | A | 8/2007 |
| CN | 200966824 | | 10/2007 |
| CN | 101084801 | A | 12/2007 |
| CN | 101130121 | A | 2/2008 |
| CN | 201044608 | Y | 4/2008 |
| DE | 2 911 565 | | 9/1980 |
| DE | 3 038 069 | A1 | 4/1982 |
| DE | 243 784 | A1 | 11/1987 |
| DE | 3 640 917 | A1 | 8/1988 |
| DE | 3 711 234 | | 10/1988 |
| DE | 3 735 704 | A1 | 5/1989 |
| DE | 301 092 | A7 | 1/1992 |
| EA | 200601250 | | 12/2006 |
| EP | 0 438 862 | | 7/1982 |
| EP | 0 239 802 | A2 | 10/1987 |
| EP | 0 277 519 | A2 | 8/1988 |
| EP | 0 358 002 | A2 | 3/1990 |
| EP | 0 358 114 | | 3/1990 |
| EP | 0 378 997 | | 4/1990 |
| EP | 0 430 566 | | 6/1991 |
| EP | 0430559 | A2 | 6/1991 |
| EP | 0435082 | A2 | 7/1991 |
| EP | 0 449 790 | A2 | 10/1991 |
| EP | 0 640 297 | A | 1/1995 |
| EP | 0 295 122 | A2 | 12/1995 |
| EP | 0 857 431 | A1 | 8/1998 |
| EP | 0 893 071 | A1 | 1/1999 |
| EP | 1 226 765 | A2 | 7/2002 |
| EP | 1302138 | A2 | 4/2003 |
| EP | 1 559 332 | A1 | 8/2005 |
| EP | 1 618 803 | A1 | 1/2006 |
| EP | 1 736 062 | A2 | 12/2006 |
| EP | 1 736 065 | A1 | 12/2006 |
| EP | 1775652 | A1 | 4/2007 |
| EP | 2110034 | A1 | 10/2009 |
| EP | 2276360 | A1 | 1/2011 |
| FR | 2879746 | A1 | 6/2006 |
| GB | 1 298 808 | | 12/1972 |
| GB | 2 132 539 | | 7/1984 |
| GB | 2 148 079 | | 5/1985 |
| GB | 2 148 676 | | 5/1985 |
| GC | 13533 | | 8/2013 |
| JP | 45-28471 | | 9/1970 |
| JP | 61-68061 | | 4/1986 |
| JP | 64-17386 | | 1/1989 |
| JP | 2-98301 | | 4/1990 |
| JP | 2-263773 | | 10/1990 |
| JP | H08511966 | A | 12/1996 |
| JP | 2002-169895 | A | 6/2002 |
| JP | 3553599 | B2 | 8/2004 |
| JP | 2004-532045 | A | 10/2004 |
| JP | 2005-034021 | | 2/2005 |
| JP | 2005-198538 | A | 7/2005 |
| JP | 2006-320286 | A | 11/2006 |
| KR | 10-0178387 | | 11/1998 |
| KR | 10-2004-0096110 | A | 11/2004 |
| KR | 100636287 | B1 | 10/2006 |
| KR | 2007-0032782 | A | 3/2007 |
| SU | 621141 | | 8/1978 |
| SU | 864597 | | 9/1981 |
| UA | 89752 | C2 | 3/2010 |
| UA | 92474 | C2 | 11/2010 |
| WO | WO 86/02528 | | 4/1986 |
| WO | WO 94/06313 | | 3/1994 |
| WO | WO 94/06314 | | 3/1994 |
| WO | WO-95/01137 | A1 | 1/1995 |
| WO | WO 95/02970 | | 2/1995 |
| WO | WO 9 527 411 | | 10/1995 |
| WO | WO-9823171 | A1 | 6/1998 |
| WO | WO 00/28843 | A1 | 3/2000 |
| WO | WO 03/095688 | A2 | 11/2003 |
| WO | WO-2004/028606 | A1 | 4/2004 |
| WO | WO 2004/043175 | A1 | 5/2004 |
| WO | WO 2004/080216 | | 9/2004 |
| WO | WO2004/095955 | | 11/2004 |
| WO | WO2005/099494 | | 10/2005 |
| WO | WO 2007/066374 | A1 | 6/2007 |
| WO | WO 2007/066167 | A1 | 7/2007 |
| WO | WO 2007/078273 | A1 | 7/2007 |
| WO | WO 2007/131449 | A1 | 11/2007 |
| WO | WO 2007/131450 | A1 | 11/2007 |
| WO | WO-2008/011659 | A1 | 1/2008 |
| WO | WO 2008/015441 | A1 | 2/2008 |
| WO | WO2008/055423 | | 5/2008 |
| WO | WO-2009/127401 | A1 | 10/2009 |
| WO | WO2010/091593 | | 8/2010 |

OTHER PUBLICATIONS

"Brazing Ceramic Oxides to Metals at Low Temperatures" by J.P. Hammond et al., published in Welding Research Supplement, 227-232-s, (1988).

"Brazing of Titanium-Vapor-Coated Silicon Nitride" by M. L. Santella, published in Advanced Ceramic Materials, 3(5):457-465 (1988).

"Microstructure of Alumina Brazed with a Silver-Cooper-Titanium Alloy" by M.L. Santella et al., published in J. Am. Ceram. Soc., 73(6):1785-1787 (1990).

Fen et al., "Cyclic oxidation of Haynes 230 alloy", Chapman & Hall, pp. 1514-1520 (1992).

Kutner, "Thermal spray by design", Reprint from Advanced Materials & Processes Incorporating Metal Progress, Oct. 1988.

"Characterizing Thermal Spray Coatings", Article based on presentation made at the Fourth National Thermal Spray Conference, May 4-10, 1991 and appearing in Advanced Materials and Processes, May 1992, pp. 23-27.

Howes, Jr., "Computerized Plasma Control for Applying Medical-Quality Coatings", Industrial Heaing, pp. 22-25, Aug. 1993.

V. Sikka, "Processing of Intermetallic Aluminides", Intermetallic Metallurgy and Processing Intermetallic Compounds, ed Stoloff et al., Van Mestrand Reinhold, N.Y., 1994.

(56) References Cited

OTHER PUBLICATIONS

Brezovich, "Temperature Distributions in Tumor Models Heater," Mar./Apr. 1984, pp. 145-152.
Gorbachev, "Compensation of Varying Load in a Thyristor," v. 56, No. 3, pp. 27-28.
Katagiri, "Rapid Reinforcement for Fusion Mass spliced Fibers using Low-Power," Jun. 1, 1985, pp. 1708-1712.
Matthes, "Thyristorised Conerters for Inductive Heating for Hot Forging," 1975, pp. 80-86.
Stauffer, "Observations on the Use of Ferromagnetic" 1984, pp. 76-90.
Reinshagen and Sikka, "Thermal Spraying of Selected Alum inides", Proceedings of the Fourth National Thermal Spray Conference, Pittsburgh, PA USA, pp. 307-313 (May 4-10, 1991).
Duarante, "A Design Procedure for a Self Oscillating Hybrid Inverter," 1991, pp. 350-355.
Xu, "The High-Frequency Inductive Electric Heater and Its Application," Apr. 1992, pp. 39-42.
Office Action for corresponding Brazilian Application No. PI 0910463-1 dated Jan. 18, 2019.
Notice of Allowance for corresponding Australian Application No. 2009237922 dated Aug. 7, 2015.
Office Action for corresponding Australian Application No. 2009237922 dated Dec. 5, 2013.
Notice of Allowance for corresponding Canadian Application No. 2,719,710 dated Feb. 2, 2017 and English translation.
Office Action for corresponding Canadian Application No. 2,719,710 dated Apr. 24, 2015.
Office Action for corresponding Canadian Application No. 2,719,710 dated Feb. 23, 2016.
Office Action for corresponding Chinese Application No. 200980113350.6 dated Jul. 25, 2011 (English translation only).
Office Action for corresponding Chinese Application No. 200980113350.6 dated Apr. 6, 2012 (English translation only).
Office Action for corresponding Chinese Application No. 200980113350.6 dated Aug. 2, 2012 (English translation only).
Office Action for corresponding Chinese Application No. 201210461424.9 dated Jun. 24, 2014 and English translation.
Office Action for corresponding Chinese Application No. 201210461424.9 dated May 20, 2015 and English translation.
Office Action for corresponding Chinese Application No. 201210461424.9 dated Nov. 20, 2015 (English translation only).
Office Action for corresponding European Application No. 08251450.6 dated Sep. 12, 2008.
Office Action for corresponding European Application No. 08251450.6 dated Dec. 12, 2008.
Office Action for corresponding European Application No. 09732942.9 dated Dec. 12, 2012.
Office Action for corresponding European Application No. 09732942.9 dated Jun. 2, 2015.
Office Action for corresponding European Application No. 16195803.8 dated Jul. 19, 2017.
Notice of Allowance for corresponding Indonesian Application No. W-00201003897 dated Jul. 13, 2015 (English translation only).
Office Action for corresponding Indonesian Application No. W-00201003897 dated May 12, 2014 (English translation only).
Office Action for corresponding Indian Application No. 6721/DELNP/2010 dated Sep. 6, 2017 and English translation.
Office Action for corresponding Japanese Application No. 2011-504371 dated Jul. 3, 2013 (English translation only).
Office Action for corresponding Japanese Application No. 2011-504371 dated Dec. 6, 2013 (English translation only).
Office Action for corresponding Japanese Application No. 2014-002966 dated Mar. 26, 2015 (English translation only).
Office Action for corresponding Japanese Application No. 2015-109819 dated Apr. 27, 2016 and English translation.
Office Action for corresponding Japanese Application No. 2015-109819 dated Apr. 5, 2017 (English translation only).
Office Action for corresponding Korean Application No. 10-2010-7023011 dated Nov. 2, 2015 (English translation only).
Notice of Allowance for corresponding Korean Application No. 10-2015-7035862 dated Dec. 23, 2016 and English translation.
Office Action for corresponding Korean Application No. 10-2015-7035862 dated Mar. 17, 2016 (English translation only).
Office Action for corresponding Korean Application No. 10-2015-7035862 dated Jul. 29, 2016 (English translation only).
Notice of Allowance for corresponding Korean Application No. 10-2015-7035864 dated Mar. 20, 2017 and English translation.
Office Action for corresponding Korean Application No. 10-2015-7035864 dated Mar. 17, 2016 (English translation only).
Office Action for corresponding Korean Application No. 10-2015-7035864 dated Jul. 28, 2016 (English translation only).
Office Action for corresponding Korean Application No. 10-2016-7030184 dated Jan. 5, 2018 (English translation only).
Office Action for corresponding Korean Application No. 10-2016-7030184 dated Sep. 26, 2018 (English translation only).
Office Action for corresponding Kazakhstan Application No. 2010/1629.1 dated Apr. 4, 2013 (English translation only).
Notice of Allowance for corresponding Kazakhstan Application No. 2010/1629.1 dated Aug. 16, 2016 (English translation only).
Office Action for corresponding Malaysian Application No. PI 2010004305 dated Apr. 30, 2014 (English translation only).
Office Action for corresponding Malaysian Application No. PI 2010004305 dated Apr. 30, 2015 (English translation only).
Notice of Allowance for corresponding Malaysian Application No. PI 2010004305 dated Jul. 14, 2015 (English translation only).
Office Action for corresponding New Zealand Application No. 587826 dated Feb. 22, 2012 (English translation only).
Office Action for corresponding New Zealand Application No. 587826 dated Sep. 3, 2013 (English translation only).
Notice of Allowance for corresponding New Zealand Application No. 587826 dated Sep. 24, 2013 (English translation only).
Office Action for corresponding New Zealand Application No. 614387 dated Aug. 29, 2013 (English translation only).
Notice of Allowance for corresponding New Zealand Application No. 614387 dated Dec. 19, 2014 (English translation only).
International Search Report and Written Opinion for Application No. PCT/EP2009/002750 dated Aug. 4, 2009.
International Preliminary Report for Application No. PCT/EP2009/002750 dated Oct. 28, 2010.
Office Action for corresponding Philippines Application No. 1/2010/502020 dated Aug. 14, 2013 (English translation only).
Office Action for corresponding Philippines Application No. 1/2010/502020 dated Aug. 3, 2012 (English translation only).
Office Action for corresponding Philippines Application No. 1/2010/502020 dated Dec. 5, 2012 (English translation only).
Office Action for corresponding Philippines Application No. 1/2013/502041 dated Aug. 7, 2015 (English translation only).
Office Action for corresponding Philippines Application No. 1/2013/502041 dated Nov. 10, 2015 (English translation only).
Office Action for corresponding Russian Application No. 2010146643 dated Apr. 12, 2013 (English translation only).
Office Action for corresponding Russian Application No. 2010146643 dated Dec. 20, 2013 (English translation only).
Office Action for corresponding Russian Application No. 2010146643 dated Aug. 1, 2014 (English translation only).
Notice of Allowance for corresponding Russian Application No. 2015102137 dated Jul. 21, 2017 (English translation only).
Office Action for corresponding Russian Application No. 2015102137 dated Nov. 29, 2016 (English translation only).
Notice of Allowance for corresponding Russian Application No. 2017140640 dated Feb. 28, 2018 (English translation only).
Notice of Allowance for corresponding Singapore Application No. 201007357-5 dated Aug. 1, 2012 (English translation only).
Office Action for corresponding Singapore Application No. 201007357-5 dated Dec. 13, 2011 (English translation only).
Notice of Allowance for corresponding Taiwanese Application No. 098112428 dated Dec. 18, 2014 (English translation only).
Office Action for corresponding Taiwanese Application No. 098112428 dated Mar. 10, 2014 (English translation only).
Office Action for corresponding Brazilian Application No. PI0910463-1 dated May 8, 2019 and English translation thereof.

(56) References Cited

OTHER PUBLICATIONS

Office Action for corresponding Korean Application No. 10-2019-7026041 dated Sep. 10, 2019 and English translation.
Notice of Allowance for corresponding Korean Application No. 2016-7030184 dated Oct. 24, 2019.
Office Action for corresponding Korean Application No. 10-2016-7030184 dated Jul. 29, 2019 and English translation thereof.
Extended European Search Report dated Dec. 18, 2019 for corresponding European Application No. 19195729.9.
Korean Notice of Allowance dated Mar. 27, 2020 for corresponding Korean Application No. 2019-7026041.
Office Action for European Application No. 16 195 803.8 dated Apr. 22, 2020.
Office Action for Korean Application No. 10-2020-7018578 dated Oct. 22, 2020.
Office Action for Brazilian Application No. PI0910463-1 dated Jun. 1, 2020 and English translation.
Office Action for corresponding European Application No. 19 195 729.9 dated Dec. 2, 2020.

* cited by examiner

ELECTRICALLY HEATED SMOKING SYSTEM

RELATED APPLICATION

This application is a continuation of U.S. application Ser. No. 13/841,197, filed Mar. 15, 2013, which is a continuation of U.S. application Ser. No. 12/425,622, filed Apr. 17, 2009, which claims priority to European Patent Application No. 0 825 1450, filed in Europe on Apr. 17, 2008. The entire content of each prior application is hereby incorporated by reference.

FIELD

The present disclosure relates generally to an electrically heated smoking system for receiving an aerosol-forming substrate.

BACKGROUND INFORMATION

A number of prior art documents, for example U.S. Pat. No. 5,060,671 (commonly owned, the entire contents of which are included herein by this reference thereto), U.S. Pat. No. 5,388,594 (commonly owned, the entire contents of which are included herein by this reference thereto), U.S. Pat. No. 5,505,214 (commonly owned, the entire contents of which are included herein by this reference thereto), U.S. Pat. No. 5,591,368 (commonly owned, the entire contents of which are included herein by this reference thereto), WO2004/043175, EP 0 358 002, EP 0 295 122, EP 1 618 803, EP 1 736 065 and WO2007/131449, disclose electrically operated smoking systems, having a number of advantages. One advantage is that electrically operated smoking systems significantly reduce sidestream smoke, while permitting the smoker to selectively suspend and reinitiate smoking.

Prior art documents, such as EP 0 295 122, EP 1 618 803 and EP 1 736 065, disclose electrical smoking systems which use a liquid as the aerosol-forming substrate. The liquid can be contained in a cartridge which is receivable in a housing. A power supply, such as a battery, is provided, connected to a heater to heat the liquid substrate during a puff, to form the aerosol which is provided to the smoker.

The electrically heated smoking systems of the prior art, including those described above, typically provide a high power pulse to the heater to provide the temperature range desired for operation and to release the volatile compounds for each puff.

The electrically heated smoking systems of the prior art, including those described above, have certain advantages, but there is still room for improvement. It is therefore an object of the disclosure to provide an improved electrically heated smoking system which offers additional functionality to the smoker.

SUMMARY

Brief Description of the Drawings

Many objects and advantages of the present disclosure will be apparent to those skilled in the art when this specification is read in conjunction with the appended drawings of an exemplary embodiment wherein like reference numerals have been applied to like elements and wherein.

DETAILED DESCRIPTION

Figure 1:
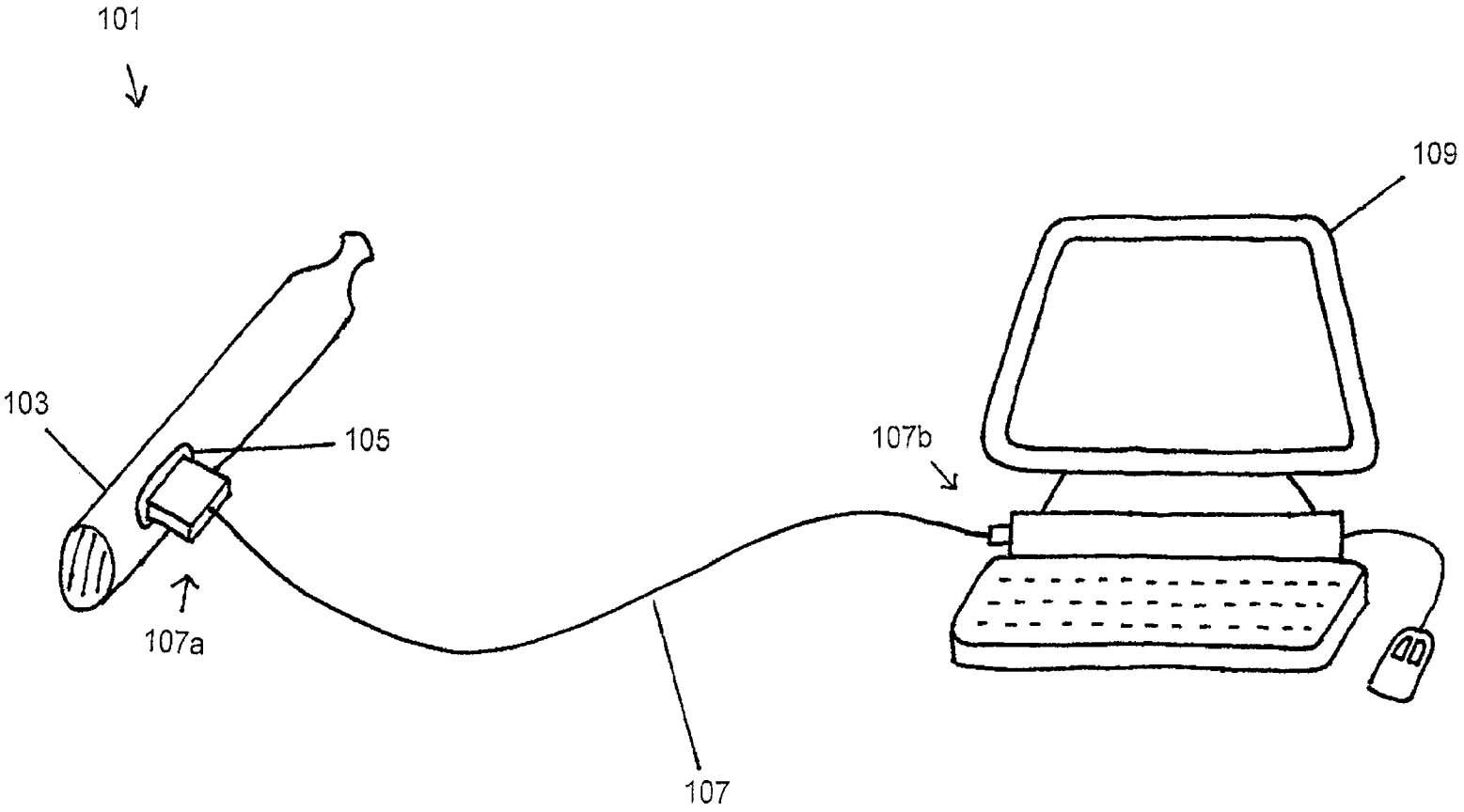
FIG. 1 depicts an embodiment of the electrically heated smoking system connected to a host via a USB link.

According to a first aspect of the disclosure there is provided an electrically heated smoking system for receiving an aerosol-forming substrate, the system including: at least one heating element for heating the substrate to form an aerosol; a power supply for supplying power to the at least one heating element; electrical hardware connected to the power supply and the at least one heating element; and an interface for establishing a communications link with a host.

By providing an interface for establishing a communications link with a host, the electrical hardware in the system itself can be relatively simple in terms of memory and processing power. This allows the electrically heated smoking system to remain relatively low cost to manufacture. The interface for establishing the communications link with the host allows interaction between the system and the host. Thus, extended features can be implemented via the host at the same time as keeping the hardware in the system itself relatively simple.

The aerosol-forming substrate preferably includes a tobacco-containing material containing volatile tobacco flavour compounds which are released from the substrate upon heating. Alternatively, the aerosol-forming substrate can comprise a non-tobacco material.

Preferably, the aerosol-forming substrate further includes an aerosol former. Examples of suitable aerosol formers are glycerine and propylene glycol. Additional examples of potentially suitable aerosol formers are described in EP 0 277 519 and U.S. Pat. No. 5,396,911.

The aerosol-forming substrate can be a solid substrate. The solid substrate can comprise, for example, one or more of: powder, granules, pellets, shreds, spaghettis, strips or sheets, where such powder, granules, pellets, shreds, spaghettis, strips or sheets can further contain one or more of: herb leaf, tobacco leaf, fragments of tobacco ribs, reconstituted tobacco, homogenized tobacco, extruded tobacco, and expanded tobacco. The solid substrate can be in loose form, or can be provided in a suitable container or cartridge, such as, for example, shredded tobacco contained by a suitable wrapper. Optionally, the solid substrate can contain additional tobacco or non-tobacco volatile flavour compounds, to be released upon heating of the substrate.

Optionally, the solid substrate can be provided on or embedded in a thermally stable carrier. The carrier can take the form of powder, granules, pellets, shreds, spaghettis, strips or sheets. Alternatively, the carrier can be a tubular carrier having a thin layer of the solid substrate deposited on its inner surface, such as those disclosed in U.S. Pat. No. 5,505,214, U.S. Pat. No. 5,591,368 and U.S. Pat. No. 5,388,594, or on its outer surface, or on both its inner and outer surfaces. Such a tubular carrier can be formed of, for example, a paper, or paper like material, a non-woven carbon fiber mat, a low mass open mesh metallic screen, or a perforated metallic foil or any other thermally stable polymer matrix.

The solid substrate can be deposited on the surface of the carrier in the form of, for example, a sheet, foam, gel or slurry. The solid substrate can be deposited on the entire surface of the carrier, or alternatively, can be deposited in a pattern in order to provide a non-uniform flavour delivery during use.

Alternatively, the carrier can be a non-woven fabric or fiber bundle into which tobacco components have been incorporated, such as that described in EP 0 857 431. The non-woven fabric or fiber bundle can comprise, for example, carbon fibers, natural cellulose fibers, or cellulose derivative fibers.

Alternatively, the carrier can be at least a part of the heating element of the electrically heated smoking system. In such cases, the heating element is typically disposable. For example, the solid substrate can be deposited as a thin layer on a metallic foil or on an electrically resistive support as described in U.S. Pat. No. 5,060,671.

The aerosol-forming substrate can be a liquid substrate. If a liquid substrate is provided, the electrically heated smoking system preferably includes means for retaining the liquid. For example, the liquid substrate can be retained in a container, such as that described in EP 0 893 071. Alternatively or in addition, the liquid substrate can be absorbed into a porous carrier material, as described in WO2007/066374, EP 1 736 062, WO2007/131449 and WO2007/131450. The porous carrier material can be made from any suitable absorbent plug or body, for example, a foamed metal or plastics material, polypropylene, terylene, nylon fibers or ceramic. The liquid substrate can be retained in the porous carrier material prior to use of the electrically heated smoking system or alternatively, the liquid substrate material can be released into the porous carrier material during, or immediately prior to use. For example, the liquid substrate can be provided in a capsule, as described in WO2007/077167. The shell of the capsule preferably melts upon heating and releases the liquid substrate into the porous carrier material. The capsule can optionally contain a solid in combination with the liquid.

If the aerosol-forming substrate is a liquid substrate, the electrically heated smoking system can further comprise means for heating a small amount of liquid at a time. The means for heating a small amount of liquid at a time can include, for example, a liquid passageway in communication with the liquid substrate, as described in EP 0 893 071. The liquid substrate is typically forced into the liquid passageway by capillary force. The heating element is preferably arranged such that, during use, only the small amount of liquid substrate within the liquid passageway, and not the liquid within the container, is heated and volatilized.

Alternatively, or in addition, if the aerosol-forming substrate is a liquid substrate, the electrically heated smoking system can further comprise an atomizer in contact with the liquid substrate source and including the at least one heating element. In addition to the heating element, the atomizer can include one or more electromechanical elements such as piezoelectric elements. Additionally or alternatively, the atomizer can also include elements that use electrostatic, electromagnetic or pneumatic effects. The electrically heated smoking system can still further comprise a condensation chamber.

The aerosol-forming substrate can alternatively be any other sort of substrate, for example, a gas substrate, or any combination of the various types of substrate. During operation, the substrate can be completely contained within the electrically heated smoking system. In that case, a user can puff on a mouthpiece of the electrically heated smoking system. Alternatively, during operation, the substrate can be partially contained within the electrically heated smoking system. In that case, the substrate can form part of a separate article and the user can puff directly on the separate article.

The at least one heating element can comprise a single heating element. Alternatively, the at least one heating element can comprise more than one heating element. The heating element or heating elements can be arranged appropriately so as to most effectively heat the aerosol-forming substrate.

The at least one heating element preferably includes an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials can comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material can optionally be embedded in, encapsulated or coated with an insulating material or vice-versa, depending on the kinetics of energy transfer and the external physicochemical properties required. Examples of suitable composite heating elements are disclosed in U.S. Pat. No. 5,498,855 (commonly owned, the entire contents of which are included herein by this reference thereto), WO03/095688 and U.S. Pat. No. 5,514,630.

Alternatively, the at least one heating element can comprise an infra-red heating element, a photonic source such as, for example, those described in U.S. Pat. No. 5,934,289 (commonly owned, the entire contents of which are included herein by this reference thereto), or an inductive heating element, such as, for example, those described in U.S. Pat. No. 5,613,505 (commonly owned, the entire contents of which are included herein by this reference thereto).

The at least one heating element can take any suitable form. For example, the at least one heating element can take the form of a heating blade, such as those described in U.S. Pat. No. 5,388,594, U.S. Pat. No. 5,591,368 and U.S. Pat. No. 5,505,214. Alternatively, the at least one heating element can take the form of a casing or substrate having different electro-conductive portions, as described in EP 1 128 741, or an electrically resistive metallic tube, as described in WO2007/066374. Where the aerosol-forming substrate is a liquid provided within a container, the container can incorporate a disposable heating element. Alternatively, one or more heating needles or rods that run through the centre of the aerosol-forming substrate, as described in KR 100636287 and JP 2006320286, can also be suitable. Alternatively, the at least one heating element can be a disk (end) heater or a combination of a disk heater with heating needles or rods. Other alternatives include a heating wire or filament, for example a Ni—Cr, platinum, tungsten or alloy wire, such as those described in EP 1 736 065, or a heating plate. Optionally, the heating element can be deposited in or on a rigid carrier material.

The at least one heating element can comprise a heat sink, or heat reservoir including a material capable of absorbing and storing heat and subsequently releasing the heat over time to the aerosol-forming substrate. Suitable heat sinks are described in EP 0 857 431, US 2006/118128 and WO2008/015441. The heat sink can be formed of any suitable material, such as a suitable metal or ceramic material. Preferably, the material has a high heat capacity (sensible heat storage material), or is a material capable of absorbing and subsequently releasing heat via a reversible process, such as a high temperature phase change. Suitable sensible heat storage materials include silica gel, alumina, carbon, glass mat, glass fiber, minerals, a metal or alloy such as aluminium, silver or lead, and a cellulose material such as paper. Other suitable materials which release heat via a reversible phase change include paraffin, sodium acetate, naphthalene, wax, polyethylene oxide, a metal, metal salt, a mixture of eutectic salts or an alloy.

The heat sink or heat reservoir can be arranged such that it is directly in contact with the aerosol-forming substrate and can transfer the stored heat directly to the substrate, as described in EP 0 857 431. Alternatively, the heat stored in the heat sink or heat reservoir can be transferred to the aerosol-forming substrate by means of a heat conductor, such as a metallic tube, as described in WO2008/015441.

The at least one heating element can heat the aerosol-forming substrate by means of conduction. The heating element can be at least partially in contact with the substrate, or the carrier on which the substrate is deposited. Alternatively, the heat from the heating element can be conducted to the substrate by means of a heat conductive element.

Alternatively, the at least one heating element can transfer heat to the incoming ambient air that is drawn through the electrically heated smoking system during use, which in turn heats the aerosol-forming substrate by convection. The ambient air can be heated before passing through the aerosol-forming substrate, as described in WO2007/066374. Alternatively, if the aerosol-forming substrate is a liquid substrate, the ambient air can be first drawn through the substrate and then heated, as described in WO2007/078273.

In a first embodiment, the power supply for supplying power to the at least one heating element includes a power cell contained in the electrically heated smoking system. In that case, the power supply can be a Lithium-ion battery or one of its variants, for example, a Lithium-ion polymer battery. Alternatively, the power supply can be a Nickel-metal hydride battery or a Nickel cadmium battery or a fuel cell. In that case, preferably, the electrically heated smoking system is usable by a smoker until the energy in the power cell is used up. Preferably, the power cell is entirely self-contained within the electrically heated smoking system.

In a second embodiment, the power supply for supplying power to the at least one heating element includes circuitry chargeable by an external charging portion. The external charging portion can form part of the electrically heated smoking system. For example, the electrically heated smoking system can comprise a portion to be held by a user, and the external charging portion. The external charging portion can take the form of a docking station. Or, the external charging portion can form part of the host. In that case, the circuitry can be charged by connection of the electrically heated smoking system with the host via the communications link. In the second embodiment, preferably the circuitry, when charged, provides power for a pre-determined number of puffs, after which the circuitry should be reconnected to the external charging portion. An example of suitable circuitry is one or more capacitors or re-chargeable batteries.

In a third embodiment, the power supply for supplying power to the at least one heating element includes an interface for connection to an external power source. Preferably, the interface is connected to the external power source at all times during use. In the third embodiment, the interface will preferably need to be connected to the external power source whenever a smoker wishes to use the system, because there is preferably no power source in the system itself. In the third embodiment, the interface can be connected to the external power source by connection of the electrically heated smoking system with the host via the communications link. That is, power can be supplied to the interface from the host, via the communications link.

Thus, in the context of the disclosure, the term "power supply" should be inferred to mean either a self-contained power cell, or chargeable circuitry, or an interface for connection to an external source or a combination of two or more of these.

The communications link can be a wireless communications link. Alternatively, the communications link can be a wired communications link. The communications link can be suitable for flow of data from the electrically heated smoking system to the host. The communications link can be suitable for flow of data from the host to the electrically heated smoking system. Preferably, the communications link is suitable for bi-directional flow of data, from the electrically heated smoking system to the host and from the host to the electrically heated smoking system. Preferably, the communications link is suitable for providing electrical power from the host to the electrically heated smoking system.

Preferably, the communications link operates under an interface standard. An interface standard is a standard that describes one or more functional characteristics, such as code conversion, line assignments, or protocol compliance, or physical characteristics, such as electrical, mechanical, or optical characteristics, necessary to allow the exchange of information between two or more systems or pieces of equipment. Examples of suitable interface standards for the communications link include, but are not limited to, the Recommended Standard 232 (RS-232) family of standards; Universal Serial Bus (USB); Bluetooth; FireWire (a brand name of Apple, Inc for their IEEE 1394 interface), IrDA (Infrared Data Association—a communications standard for the short-range exchange of data by Infrared light); Zigbee (a specification based on the IEEE 802.15.4 standard for wireless personal area networks) and other Wi-Fi standards.

In a preferred embodiment, the communications link is a Universal Serial Bus—USB—link. This is advantageous because a USB communications link provides bi-directional communication and also a power link (usually 5 V).

Preferably, the host is Internet-enabled. That is, preferably the host is able to connect to one or more Internet sites in order to upload data or download data or both upload and download data. This allows extended features to be implemented from the Internet via the host, at the same time as keeping the hardware in the system itself relatively simple. Throughout the specification, in the context of the present disclosure, the term "Internet" is used to refer to the worldwide, publicly accessible series of interconnected computer networks that transmit data using the standard Internet Protocol (IP). It includes the World Wide Web (www) but also includes other domestic, academic, business, government and other networks outside the World Wide Web.

The host can be a personal computer. The personal computer can be a desktop computer. The personal computer can be a laptop computer or a notebook computer. The personal computer can be a tablet computer such as a Personal Digital Assistant (PDA), a Personal Information Device (PID), a Portable Media Player (PMP, such as an Apple, Inc iPod®) or a Portable Video Player (PVP). The host can be a mobile cellular telephone.

The interface is an interface suitable for the particular communications link. For example, in the case of a wireless communications link, the interface can comprise one of: a receiver for receipt of wireless signals from the host; a transmitter for sending wireless signals to the host; and a transceiver for receiving wireless signals from, and sending wireless signals to, the host. For example, in the case of a wired communications link, the interface can comprise one or both of: a male connector for connection with a female connector on or connected to the host; and a female connector for connection with a male connector on or connected to the host.

The communications link is preferably suitable for one or more of the following functions: for downloading software from the host to the system; for downloading information from the host to the system; for charging the system; for uploading information from the system to the host; and for registering the system with the host. If the host is Internet-enabled, those functions can take place whilst the host is accessing an Internet site, or separately from the host accessing an Internet site.

Preferably, the electrical hardware is programmable by software. The software can be downloadable from the host via the communications link.

Preferably the electrical hardware includes a sensor to detect air flow indicative of a user taking a puff. The sensor can be an electro-mechanical device. Alternatively, the sensor can be any of: a mechanical device, an optical device, an opto-mechanical device and a micro electro-mechanical-systems (MEMS) based sensor. In that case, preferably the electrical hardware is arranged to provide an electric current pulse to the at least one heating element when the sensor senses a user taking a puff. Preferably the time-period of the electric current pulse is pre-set, depending on the amount of aerosol desired. The electrical hardware is preferably programmable for this purpose.

Alternatively, the electrical hardware can comprise a manually operable switch for a user to initiate a puff. In that case, preferably the electrical hardware is arranged to provide an electric current pulse to the at least one heating element when the user initiates a puff. Preferably, the time period of the electric current pulse is pre-set depending on the amount of aerosol desired. The electrical hardware is preferably programmable for this purpose.

The electrically heated smoking system can further comprise a puff indicator for indicating when the heating element is activated. In the embodiment in which the electrical hardware includes a sensor to detect air flow indicative of a user taking a puff, the indicator can be activated when the sensor senses air flow indicative of the user taking a puff. In the embodiment in which the electrical hardware includes a manually operable switch, the indicator can be activated by the switch.

The electrically heated smoking system can further comprise a housing for receiving the aerosol-forming substrate and designed to be grasped by a user. The housing can comprise a shell and a replaceable mouthpiece.

DETAILED DESCRIPTION OF THE PREFERRED EMBODIMENT

Figure 2:
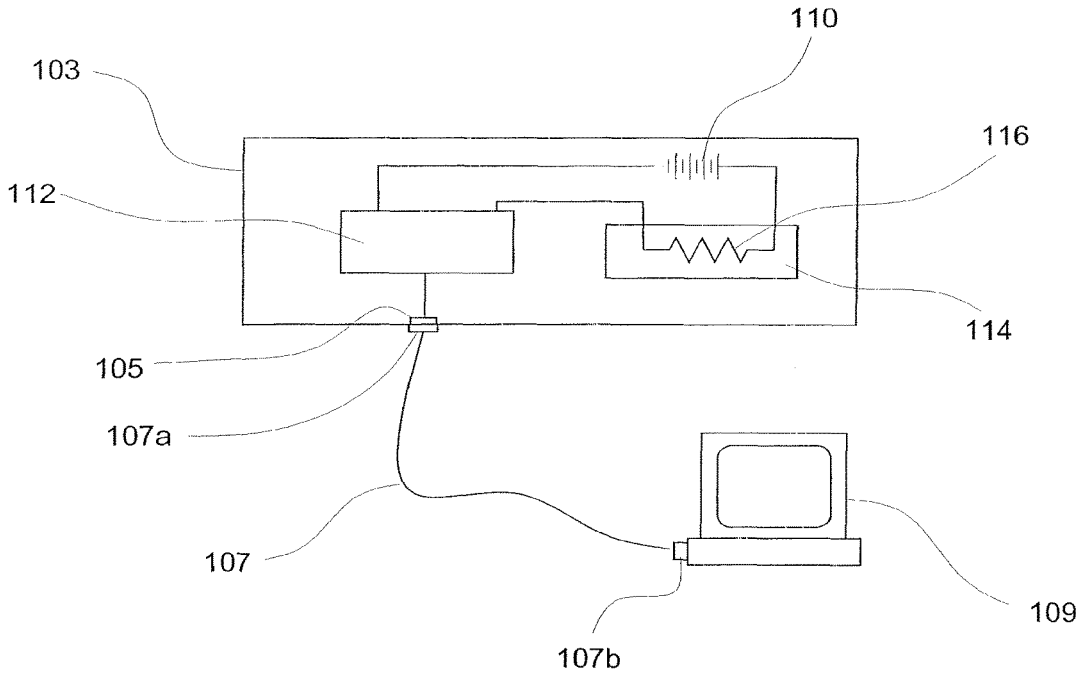
FIG. 2 is a schematic illustration of the electrically heated smoking system of FIG. 1.

Referring to FIG. 1, in this embodiment, the electrically heated smoking system in the form of device 101 includes a housing 103 containing a power supply 110 (see FIG. 2) in the form, for example, of a Lithium-ion battery, electrically connected to electrical hardware 112 in the form, for example, of a printed circuit board. In addition, an aerosol-forming substrate 114, which can be in the form of a tobacco plug can be contained in the housing 103. A heating element 116, which can be in the form of a heating blade, for example, in contact with the tobacco plug, can also be electrically connected with the power supply 110 and the electrical hardware 112. The housing 103 can also include an interface 105, which can be in the form of a USB socket, for receiving a first end 107*a* of a communications link 107 that can be in the form of a USB connector. A second end 107*b* of the communications link 107 can be plugged into a host 109, that can be in the form of Personal Computer (PC). The PC 109 is Internet-enabled.

The hardware in the device 101 includes a limited set of software-supporting components. This allows the device itself to remain relatively simple in terms of memory and processing power. Extended capabilities for the device (to be discussed below) are hosted on the Internet-enabled PC 109 and transferred to and from the device 101 as required. Thus, the device can be connected, via the PC 109, to one or more approved Internet sites. In this embodiment, the link is a USB link which provides bi-directional communication and can also provide power to the device.

A number of extended capabilities are possible, as follows:

Firstly, software can be downloaded from the PC to the device. The software can include updated versions of software, as software develops, or to fix a specific bug. Alternatively, or in addition, the software can include additional features, which are, for example downloadable after payment by the user. This removes the need for the device to be returned to the supplier or manufacturer for software downloads. This capability is not limited to the device 101 and PC 109 of FIG. 1, but can apply to any electrically heated smoking system according to the disclosure.

Secondly, information can be downloaded from the PC to the device. For example, a user can personalize the device by specifying information such as a maximum number of puffs permitted per time period, and a minimum interval between puffs. This can assist with managing smoking behaviour. Alternatively, or in addition, the user can specify the brand of tobacco plug being used and control parameters can then be downloaded from the PC to the device, to optimize the smoking experience for that brand. Alternatively, or in addition, further features could be downloaded, for example auto-shutdown after a selected period of inactivity. This could be used as a security feature to prevent a lost or stolen device being used without authorisation. Again, this capability is not limited to the device 101 and PC 109 of FIG. 1, but can apply to any electrically heated smoking system according to the disclosure. If the user specifies a brand, this will be the brand of the particular aerosol-forming substrate being used.

Thirdly, the PC can provide electrical power to the device. For example, if the device contains a rechargeable battery or other chargeable circuitry, the connection could be used to re-charge the battery or circuitry. This can be the case in the FIG. 1 embodiment. Or, if the device does not contain an internal power source, the PC can provide electrical power to the device while the device is being used by a smoker. This will mean that it is necessary to have the device and PC connected, while the device is being used. This capability is not limited to the device 101 and PC 109 of FIG. 1, but can apply to any electrically heated smoking system according to the disclosure.

Fourthly, information can be uploaded from the device to the PC. For example, for acquiring smoking behaviour information during clinical trials, the user can simply connect the device to the PC to upload data. This would automate much of the data collection and analysis, speeding up the process whilst minimising the data errors that are inherent in manual systems. Or, for assistance with managing smoking behaviour, the user could upload smoking behaviour information, to track the data and note improvements. Again, this capability is not limited to the device 101 and PC 109 of FIG. 1, but can apply to any electrically heated smoking system according to the disclosure.

Fifthly, the connection could be used for a user to register the device with an Internet application supported on the PC. For example, this could be used as a security feature if the device is supplied by post, so that the device is only enabled after registration. This capability is not limited to the device 101 and PC 109 of FIG. 1, but can apply to any electrically heated smoking system according to the disclosure.

Other possible capabilities include, but are not limited to:

Pay-as-you-smoke functionality. For example the user buys daily or weekly or monthly smoking time from the Internet application supported on the PC, or the user obtains smoking time credits based on cigarettes and other smoking articles bought via the Internet application.

The device could be pre-loaded with credit which could be used to buy items, such as smoking articles, from the Internet application.

The Internet application hosted on the PC could be an approved support group Internet site for assistance with smoking cessation. The Internet application could offer a controlled amount of smoking time whilst monitoring the smoking behaviour.

If the device operates with separate smoking articles, the Internet application could recommend the most suitable smoking articles for the device, when the device is connected to the PC. Or similarly, for any type of aerosol-forming substrate, the Internet application could recommend the most suitable brands for the device.

If the device operates with separate smoking articles, the Internet application could monitor usage and automatically pre-order additional smoking articles when required. Or similarly, for any type of aerosol-forming substrate, the Internet application could monitor usage and pre-order aerosol-forming substrate when appropriate.

The Internet application could monitor usage of the device and recommend maintenance at appropriate junctures.

The device could include additional functionality, such as an MP3 player, satellite navigation and so forth, which could be downloaded to the device from the PC.

Clearly, these capabilities are not limited to the device 101 and PC 109 of FIG. 1, but can apply to any electrically heated smoking system according to the disclosure.

Thus, a large number of extended capabilities can be provided, not limited to those listed above. The interface for connection via a communications link to the host, allows the electrically heated smoking system itself to be kept relatively simple and low-cost to manufacture, whilst providing capability for advanced functionality via the communications link.

The summary, abstract, and other parts of this specification are intended to be illustrative, but not limiting. Accordingly, it is intended that all parts of this specification should be taken as a whole and not interpreted in any way to limit the breadth or generality of other parts of this specification.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. An electrically heated smoking system comprising:

a housing configured to receive an aerosol-forming substrate;

a heater disposed within the housing, the heater including a conductive ceramic material and platinum deposited on a carrier material that is configured to be positioned in contact with the aerosol-forming substrate to heat the aerosol-forming substrate, the conductive ceramic material including molybdenum disilicide;

electrical hardware disposed within the housing and connected to the heater, the electrical hardware configured to control the heater and to store parameters associated with an operation of the heater in memory; and an interface configured to connect the electrical hardware to a host device, the interface configured to facilitate a transmission of at least one of data and power between the electrical hardware and the host device, the interface being in a form of a USB socket.

2. The electrically heated smoking system of claim 1, wherein the interface is configured to connect the electrical hardware to a remote network device via the host device.

3. The electrically heated smoking system of claim 2, wherein the host device is internet-enabled.

4. The electrically heated smoking system of claim 1, wherein the data includes at least one of a type of the aerosol-forming substrate and an amount of an allowed smoking time.

5. The electrically heated smoking system of claim 4, wherein the electrical hardware is configured to set a time period that an electric current pulse is applied to the heater.

6. The electrically heated smoking system of claim 1, wherein the data includes at least one of a type of the aerosol-forming substrate and an auto-shutdown information that instructs the electrical hardware to disable the heater after a period of inactivity.

7. The electrically heated smoking system of claim 1, wherein the heater further includes silver as a heat sink.

8. The electrically heated smoking system of claim 1, wherein the aerosol-forming substrate is in a form of a tobacco plug, and the conductive ceramic material and platinum deposited on the carrier material of the heater is configured to be positioned in contact with the tobacco plug.

* * * * *